United States Patent [19]

Fujita et al.

[11] 4,253,039

[45] Feb. 24, 1981

[54] IMAGE PICKUP TUBE WITH RECTANGULAR SUPPORT PLATE FOR STRIPE FILTER

[75] Inventors: Tsutomu Fujita; Mitsuo Ichikawa; Tatsuhiko Iida; Toshiki Suzuki; Siro Aizawa, all of Mobara, Japan

[73] Assignee: Hitachi, Ltd., Tokyo, Japan

[21] Appl. No.: 33,488

[22] Filed: Apr. 26, 1979

[30] Foreign Application Priority Data

May 4, 1978 [JP] Japan ..... 53-52763

[51] Int. Cl.[3] ..... H01J 29/45; H01J 31/38

[52] U.S. Cl. ..... 313/371; 313/384

[58] Field of Search ..... 313/384, 371, 388, 390

[56] References Cited

U.S. PATENT DOCUMENTS

| | | | |
|---|---|---|---|
| 3,188,506 | 6/1965 | Rome | 313/390 |
| 3,857,037 | 12/1974 | Tomii et al. | 312/384 X |
| 3,927,340 | 12/1975 | Suzuki | 313/371 |
| 4,166,969 | 9/1979 | Hoeberechts | 313/371 |

OTHER PUBLICATIONS

"A Color Separating Filter . . . . ", by S. Nobutoki et al., IEEE Transactions on Electron Devices, vol. Ed-18, No. 11, Nov. 1971, pp. 1094-1100.

*Primary Examiner*—Palmer C. Demeo

*Attorney, Agent, or Firm*—Charles E. Pfund

[57] ABSTRACT

A faceplate structure of a multi-color image pickup tube has a light transmitting thin glass plate, to which are bonded a rectangular color separating filter base plate deposited with a color separating stripe filter at the center of one surface of the thin glass plate with the color separating stripe filter opposing the thin glass plate, and a collar plate having a rectangular through hole for receiving therein the color separating filter base plate. On the other surface of the light transmitting thin glass plate are successively deposited a transparent electroconductive film and a photoconductive film. The faceplate structure is airtightly secured to one open end of an envelope of the image pickup tube with its other surface opposing the inside of the envelope.

5 Claims, 6 Drawing Figures

IMAGE PICKUP TUBE WITH RECTANGULAR SUPPORT PLATE FOR STRIPE FILTER

BACKGROUND OF THE INVENTION

The present invention concerns image pickup tubes, and more particularly it concerns a faceplate structure of the same. Generally, the television camera requires three image pickup tubes, since one image pickup tube is required for obtaining one of three different color signals of green, blue and red. However, there has been developed recently a multi-color image pickup tube or a single tube type color image pickup tube which can take out chrominance signals of two or three colors from one image pickup tube.

In FIGS. 1 and 2 is shown a conventional multi-color image pickup tube wherein over the surface of a faceplate 1 made of light transmitting material such as glass are deposited successively a color separating stripe filter (hereinafter referred to as color separating filter) 2, a thin glass plate 4 via an adhesive 3, a transparent electroconductive film 5, and a photoconductive film 6 to form a faceplate structure 100, the faceplate structure 100 being airtightly secured to one open end of an envelope 10 by a sealing material 7 of indium attached with a signal electrode 8 such that the inside of the envelope 10 is evacuated to vacuum. Light 12 from an object 11 is focused on the photoconductive film 6 via an optical lens 13, thereby forming a charged pattern image corresponding to an image of the object 11 in the photoconductive film 6. An electron beam 14 from an electron gun 9 is focused and scanned on the surface of the photoconductive film 6 by the magnetic field formed by a deflecting coil 15 and a focusing coil 16 arranged around the outer periphery of the envelope 10 to convert the charged pattern into electric current to be taken out from the signal electrode 8 as an electric signal via transparent electroconductive film 5 and indium sealing material 7.

However, in the image pickup tube constructed as above, the faceplate 1 is shaped circular, and there is formed a color separating filter having a correspondingly circular outer periphery on the surface of the faceplate. This necessarily causes waste in material when trying to make a number of filters from out of one sheet of material in the mass production, thereby raising the production cost. Therefore, it has hitherto been proposed to eliminate the waste in the material of the filter by using a color separating filter of a rectangular shape which corresponds to the effective area of the faceplate (normally the rectangular portion at the center of the faceplate). This proposal uses the color separating filter disposed in the vacuum within the envelope 10 and requires this filter to be adaptive for use in vacuum. Thus, both the adhesive and the filter material are limited to the inorganic material, since organic materials are not stable in vacuum as they discharge a great amount of gas. For this reason, it has been extremely difficult to practically manufacture the faceplate structure incorporating the rectangular color separating filter made of the organic material such as prepared by dye method, in spite of the recent remarkable development in the manufacturing technology for color separating filters of organic material.

SUMMARY OF THE INVENTION

The present invention, therefore, aims to obviate the defects as mentioned above, and has for its prime object to provide an image pickup tube having a faceplate structure which can be manufactured efficiently and at a low cost.

In order to achieve the above object, in an image pickup tube according to the present invention, a rectangular filter base plate deposited with a color separating stripe filter is bonded to a light transmitting thin glass plate at the central portion thereof, and a collar plate having a rectangular through hole is bonded to the light transmitting thin glass plate with the rectangular base plate received within the rectangular through hole, while providing transparent electroconductive and photoconductive films on the other side of the light transmitting thin glass plate, thereby forming a faceplate structure. The faceplate structure is airtightly secured to one open end of an envelope of the image pickup tube with its film side facing the inside of the envelope.

DESCRIPTION OF THE PREFERRED EMBODIMENT

Figure 1:
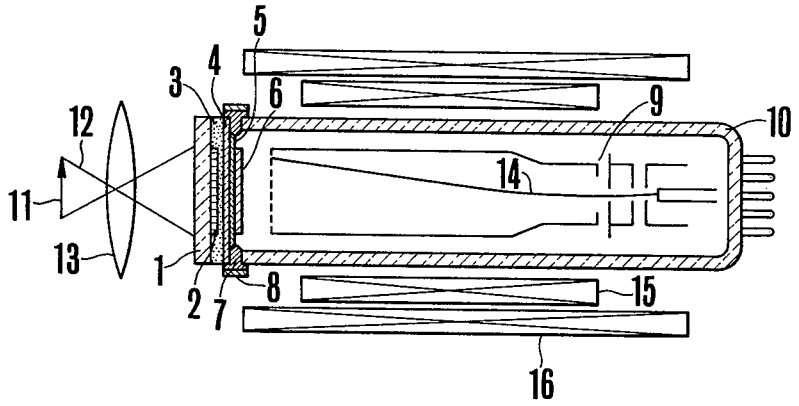
FIG. 1 (PRIOR ART)
FIG. 1 is a longitudinal sectional view showing one example of a conventional image pickup tube.
Figure 2:
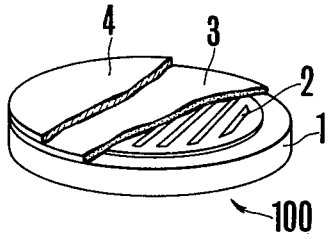
FIG. 2 (PRIOR ART)
FIG. 2 is a perspective view, partly exploded, showing a faceplate structure of the image pickup tube shown in FIG. 1.
Figure 3A:
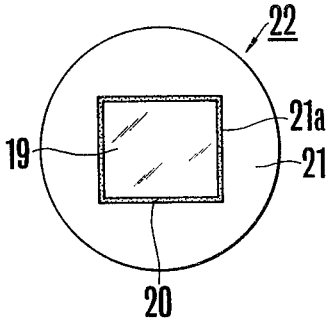
FIGS. 3*a*, 3*b* and 3*c* are respectively a plan view, a sectional view and a partially exploded perspective view of one embodiment of a faceplate structure of image pickup tube in accordance with the present invention.
Figure 3B:
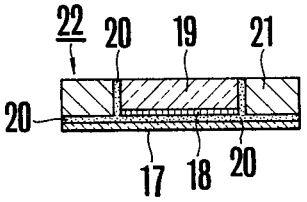
Figure 3C:
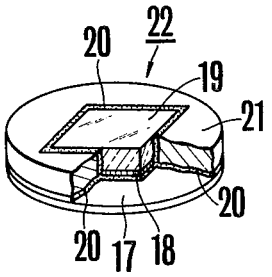
Figure 4:
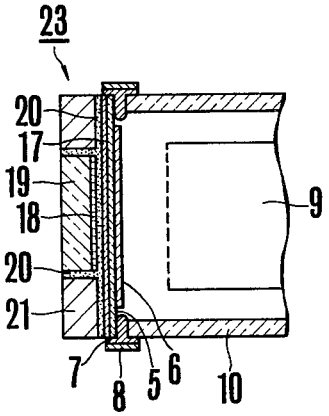
FIG. 4 is a partial sectional view of one embodiment of an image pickup tube in accordance with the present invention.

Referring to FIGS. 3*a*, 3*b* and 3*c*, a rectangular light transmitting color separating stripe filter base plate 19 (hereinafter referred to as color separating filter base plate) deposited with a color separating stripe filter 18 (hereinafter referred to as color separating filter) is bonded to one surface of a circular light transmitting thin glass plate 17 at the central portion thereof with an adhesive 20 with its color separating filter 18 opposing the surface of the glass plate 17. The surface area of the color separating filter base plate 19 which may be made of transparent glass substantially equals the effective area of the image pickup tube faceplate, i.e. the area through which an object to be picked up is effectively picked up. The bonding agent 20 can be of either inorganic or organic material. A collar plate 21 is also bonded to the one surface of this light transmitting thin glass plate 17 with adhesive 20. The collar plate 21 has a rectangular through hole 21*a* for receiving therein the color separating filter base plate 19. In the gap between the outer peripheral surface of the color separating filter base plate 19 and the inner peripheral surface of the collar plate 21 is applied and hardened the adhesive 20 to put together one surface component elements of a faceplate structure 22. As shown in section in FIG. 4, the faceplate structure 22 formed with the one surface component elements is successively deposited on its other surface with a transparent electroconductive film 5 and a photoconductive film 6 similar to those of the prior art by vapor-deposition, for example. The resulting faceplate structure is then airtightly secured to one open end of an envelope 10 via a sealing material 7 of indium with the other surface component elements opposing an electron gun 9, thereby completing an image pickup tube.

The collar plate 21 is provided to strengthen the thin glass plate 17 against vacuum, and it is not necessary that the collar plate be transparent. Accordingly, the material of the collar plate is not limited to glass alone, but ceramic or non-magnetic metal can be used. If ceramic is used, the rectangular hole centered with the color separating filter base plate 19 can be formed by molding prior to sintering, while in the case of metal, mass production technique such as press forming may be emplofyed. Thus, the production efficiency is in no way hindered even when the image pickup tube faceplate is divided into the rectangular color separating filter base plate 19 and the collar plate 21 of circular outer contour and these are bonded together and to the thin glass plate 17.

One example of dimensions for the faceplate structure of 1-inch image pickup tube in accordance with the present invention is given below.

Outer diameter of collar plate 21: 26.2 mm
Thickness of collar plate 21: 2.5 mm
Length of color separating filter base plate: 14 mm
Width of color separating filter base plate: 11 mm
Total thickness of adhesive and thin glass plate: 0.04 mm As is clear from the above dimensions, the thin glass plate and adhesive are shown in magnified scale in the accompanying drawings for convenience of illustration.

In the image pickup tube constructed in accordance with the present invention, particularly in the faceplate structure, the use of rectangular color separating filter base plate 19 cut out in square enables to improve production rate of the color separating filter, that is, the number of filters yielding from one sheet of material, thereby decreasing cost of the color separating filter 18 and bringing about low cost production of multi-color image pickup tubes.

Further, not only the adhesive which bonds the color separating filter base plate 19 deposited with the color separating filter 18 and the collar plate 21 to the thin glass plate 17 but also the color separating filter 18 is unexposed to the vacuum in the envelope 10. Thus, it is possible to use an adhesive of organic material which has poor vacuum withstandability due to the fact that it is unstable in vacuum or discharges a great amount of gas, resulting in tendency to decomposition.

The collar plate 21 which is provided to maintain the strength of the thin glass plate 17 may be formed with an additional rectangular boring of about 3 to 4 mm side which will not impair the robustness of the collar plate, and transistors or IC chips may then be embedded in the boring. The embedded transistors or IC chips may further be connected to resistors, coils and capacitors to construct at least the initial stage of preamplifier for the image pickup tube. In this manner, the preamplifier initial stage can be arranged in the proximity of the signal output electrode 8, thereby improving the S/N ratio of the output signal.

What is claimed is:

1. An image pickup tube of the type wherein a faceplate structure having a light transmitting plate provided with at least color separating stripe filter, transparent electroconductive film and photoconductive film is airtightly secured to one open end of an envelope, said faceplate structure comprising:

a light transmitting thin glass plate comprised by the light transmitting plate;

a rectangular color separating filter base plate deposited on one surface with the color separating stripe filter and bonded to one surface of said light transmitting thin glass plate at the central portion thereof with said color separating stripe filter opposing said light transmitting thin glass;

a collar plate having a rectangular through hole for receiving said color separating filter base plate and bonded to the one surface of said thin glass plate with said filter base plate received in said rectangular through hole; and transparent electrode and photoconductive films deposited successively on the other surface of said light transmitting thin glass plate, said faceplate structure being airtightly secured to the one open end of the envelope with its other surface opposing the inside of said envelope.

2. An image pickup tube of claim 1 wherein the surface area of said color separating filter base plate is substantially equal to the effective area of the image pickup tube faceplate.

3. An image pickup tube of claim 1 wherein said collar plate is made of ceramic.

4. An image pickup tube of claim 1 wherein said collar plate is made of non-magnetic metal.

5. An image pickup tube of claim 1 wherein said color separating stripe filter is made of organic material and bonding of said color separating filter base plate and the collar plate is effected with organic adhesive.

* * * * *